US010147255B1

(12) United States Patent
Rais

(10) Patent No.: US 10,147,255 B1
(45) Date of Patent: Dec. 4, 2018

(54) BATTERY FREE SMART LOCK

(71) Applicant: Elliot Rais, New York, NY (US)

(72) Inventor: Elliot Rais, New York, NY (US)

( * ) Notice: Subject to any disclaimer, the term of this patent is extended or adjusted under 35 U.S.C. 154(b) by 0 days.

(21) Appl. No.: 15/869,474

(22) Filed: Jan. 12, 2018

Related U.S. Application Data

(63) Continuation-in-part of application No. 15/598,777, filed on May 18, 2017.

(60) Provisional application No. 62/585,053, filed on Nov. 13, 2017.

(51) Int. Cl.
*G07C 9/00* (2006.01)
*E05B 47/02* (2006.01)
*E05B 47/06* (2006.01)

(52) U.S. Cl.
CPC ..... *G07C 9/00309* (2013.01); *E05B 47/026* (2013.01); *E05B 47/06* (2013.01); *G07C 9/00015* (2013.01)

(58) Field of Classification Search
None
See application file for complete search history.

(56) References Cited

U.S. PATENT DOCUMENTS 4,912,460 A * 3/1990 Chu ..... G07C 9/00658 310/330
2005/0099262 A1* 5/2005 Childress ..... G07C 9/00309 340/5.6
2006/0164206 A1* 7/2006 Buckingham ..... E05B 47/00 340/5.6
2007/0296545 A1* 12/2007 Clare ..... E05B 67/00 340/5.64
2008/0006695 A1* 1/2008 Morita ..... G06K 7/0008 235/449
2008/0252415 A1* 10/2008 Larson ..... E05B 19/0005 340/5.73
2010/0073129 A1* 3/2010 Pukari ..... E05B 47/02 340/5.8
2013/0065530 A1* 3/2013 Gansen ..... H04L 12/66 455/41.2

(Continued)

FOREIGN PATENT DOCUMENTS

GB 2443633 A * 5/2008 ..... A47G 29/141
WO WO 2011113987 A1 * 9/2011 ..... G07C 9/00857

*Primary Examiner* — Chico A Foxx
(74) *Attorney, Agent, or Firm* — Israel Nissenbaum; Yitzy Nissenbaum

(57) ABSTRACT

A smart lock system and method having a smart lock element, a data entry interface element; a mechanically operated power generator such as a dynamo as the sole power source; and an electronic control element. A separate controller is in communication with the smart lock element, only when the dynamo provides power to the smart lock. The controller element constantly receives and store updated key code information from a remote location source. With the providing of the operating energy to the smart lock the electronic control element receives and stores updated key code information from the controller, if any, prior to any unlocking activation of the locking mechanism. The electronic control element compares stored key code information with entered key codes and the locking mechanism is unlocked thereafter with entry of a valid key code corresponding to a key code stored in the electronic control element.

4 Claims, 2 Drawing Sheets

(56) References Cited

U.S. PATENT DOCUMENTS

Figure 1:
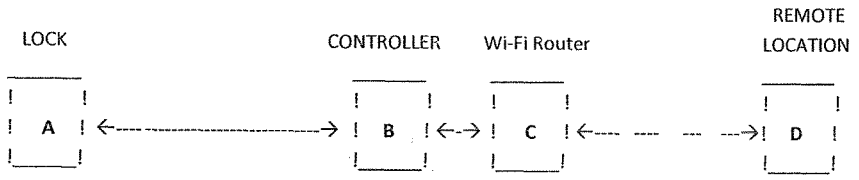

| | | | | |
|---|---|---|---|---|
| 2013/0120110 | A1* | 5/2013 | Kalous | G05B 1/01 340/5.54 |
| 2014/0340195 | A1* | 11/2014 | Polak | G07C 9/00571 340/5.61 |
| 2015/0139423 | A1* | 5/2015 | Hildebrandt | G07C 9/00571 380/270 |
| 2015/0254915 | A1* | 9/2015 | Lovelock | G07C 9/00015 340/5.54 |
| 2015/0287256 | A1* | 10/2015 | Davis | G05B 19/02 340/5.25 |
| 2016/0028714 | A1* | 1/2016 | Umberger | G06F 8/654 726/18 |

* cited by examiner

BATTERY FREE SMART LOCK

This application is a continuation in part of pending application Ser. No. 15/598,777 filed May 18, 2017, the disclosure of which is entirely included herein by reference thereto.

FIELD OF THE INVENTION

This invention relates to smart locks with update code communication and particularly to smart locks without batteries subject to degradation and depletion.

BACKGROUND

Smart locks are known devices which are affixed to doors or other entrances, with the smart lock having an integrated interface, most commonly a key pad, for the entry of key codes for opening of the door to which it is affixed. Other types of interfaces include magnetic key cards for insertion into the lock or RF controlled cards for proximate placement to the lock.

For ease of installation and lower cost for the lock and installation, the smart lock is provided with a battery power source rather than being hard wired into electrical supply systems. In addition, the battery, with a constant-on and powering mode, enables the smart lock to be in constant communication, usually via local wi-fi internet connection, to a central computer which periodically transmits periodically updated key codes for enhanced security. In view of this constantly required connection a full time power source is required and batteries are the full time power source of preference. If only lock activation is required, on-demand electrical power may be provided such as via mechanically operated dynamos. Such dynamos are described, for example, in U.S. Pat. No. 8,354,914 issued to Duane Buckingham and in US Patent Publication 2005/0099262 by Robert Childress, for use in powering door lock operations. However, for actual communication with a central computer, Childress requires a separate cell phone connected to the lock with an audio signal and Buckingham relies on a separate controller distanced from the lock. The parent of this application also discloses the use of a dynamo for powering a smart lock as an emergency source of power for opening a door with depletion of primary battery power for the smart lock Smart locks, as they are known, have thus not been able to be fully operable without a battery or a hard wired connection.

SUMMARY OF THE INVENTION

It is accordingly an object of the present invention to provide a smart lock system which is not powered by a battery, detrimentally subject to depletion and failure, yet which is able to function with all of the battery powered smart lock functions including the ability to program key codes and other functions remotely, via a typical wi-fi connection.

Generally, the invention comprises a smart lock system and method of smart lock operation which does not require battery power. The smart lock system herein is comprised of a smart lock which is powered only with a failure resistant dynamo, such as shown in the parent application, but without the need for batteries for full smart lock operation including lock operational updating.

The smart lock system comprises:

a) an electrically operable smart lock element configured to be affixed to a door and having a locking mechanism configured for locking/unlocking the door;

b) a data entry interface element directly associated with the smart lock element configured for the entry of a valid key code for opening of the locking mechanism and the door;

c) a mechanically operated power generator directly associated with the smart lock for providing operating energy for powering the smart lock element, without battery power, for the data entry interface for operative entry of the key code for unlocking the locking mechanism;

d) a separate controller element configured to be in communication with the smart lock element, via a communication connection, when the mechanically operated power generator provides operating energy to the smart lock element, and wherein the controller element is configured to constantly receive and store updated key code information from a remote location source;

e) a communication router to which the smart lock element is electronically connected, when provided with the operating energy;

f) an electronic control element within the smart lock element configured to synchronize with the controller element, with the providing of the operating energy and activation of the electronic control element with an activation element to receive and store updated key code information, if any, prior to any unlocking activation of the locking mechanism, and with the electronic control element configured to compare stored key code information with entered key codes via the data entry interface;

wherein the locking mechanism is configured to be unlocked thereafter with entry of a valid key code corresponding to a key code stored in the electronic control element.

The operations of opening or closing of the lock is effected by mechanical winding of the dynamo which supplies power for a very limited period of time just sufficient to power the interface such as a key pad for opening the electrically controlled lock. The dynamo winding mechanism, in one embodiment, is integrated with a latch handle of the smart lock.

For the additional smart lock operations of the system, a separate controller is provided with wi-fi or direct route internet or other communication access and the smart lock is similarly provided with immediate access to wi-fi or direct route internet or other communication access upon being powered. The controller is constantly on and programmed to communicate with the lock at any time when the lock is powered by the dynamo. A remote station is in contact such as with an internet connection with the controller at all times.

In order to provide programming of key codes, the smart lock system comprises the communication connected controller which is configured to communicate with the lock with the following protocol and lock configuration and operation:

Opening of the lock is effected by lifting the latch lever of the lock in an upward direction to spring load the dynamo with this movement and then the lever is returned to the neutral normal position. Upward lever movement initiates a program in which:

a) The lock contains an electronic control element which is caused to synchronize with the controller to receive stored latest key codes and which, in turn, notifies the controller of the initial operation of the lock, then b) The electronic control element of the lock compares digits entered on the keypad with its internally stored and updated code list and determines a proper response (valid and opening of the lock, invalid and no opening).

Key codes are remotely programmed from the remote station with the adding or deleting of key codes at any time via the communication connection between the remote station, at which the key codes are generated or removed, and the controller. The commands with key codes are stored only in the controller, without necessity for the lock to be powered. The lock is configured to synchronize with the controller, as described above, at the initiation step before lock opening action is effected with the stored transmission of required current key code data for lock operation. As a result, there is always full smart lock function even without the presence of a battery or any constant source of power.

The method of operation of the smart lock for opening a door comprises the steps of:

a) providing a smart lock on a door, with the smart lock having a data entry interface for entry of a valid key code and an electronic control element, with only a mechanically operated dynamo as a power source for the smart lock;

b) providing a controller element separate from the smart lock and configured to be in data transmission communication with the smart lock only upon powering of the smart lock with the dynamo, wherein the controller element is configured to receive updated key code information and to transmit the updated key code information to the smart lock for operational storage in the electronic control element;

c) configuring the mechanically operated dynamo to open communication with the controller upon initial activation to effect transmission of updated key code information; and d) completion of powering the smart lock with the dynamo and entry of a key code via the data entry interface; and e) comparison by the electronic control element of an entered key code with a stored key code for the validation thereof and the opening of the door.

Though the lock system by Buckingham, as described in U.S. Pat. No. 8,354,914, includes a controller it is not provided with any key code update function or synchronization with the smart lock, except for functions such as remote powering of the lock.

The above objective and other features and advantages of the invention will become more evident from the following drawings in which:

SHORT DESCRIPTION OF THE DRAWINGS

Figure 2:
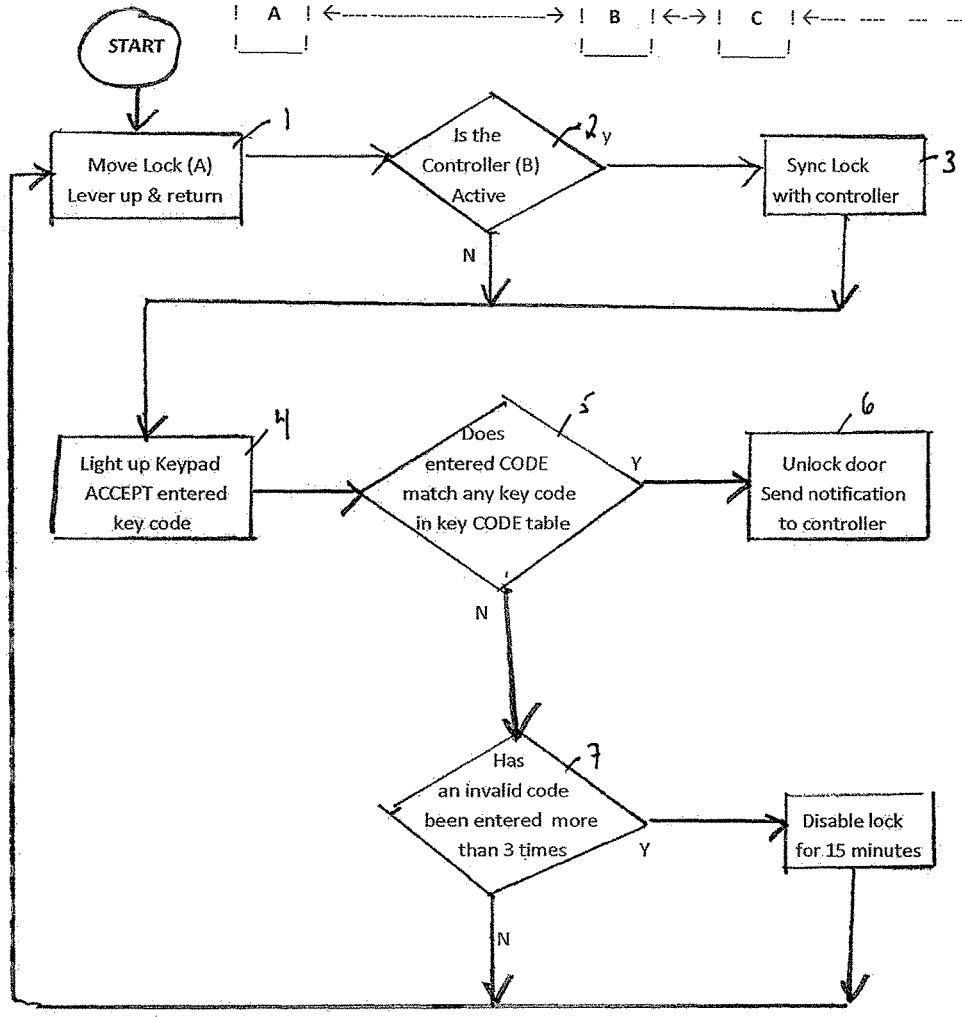

FIG. 1 is a schematic view of the components of the system of the invention, and FIG. 2 is a schematic flow chart of the system operation.

Figure 3:
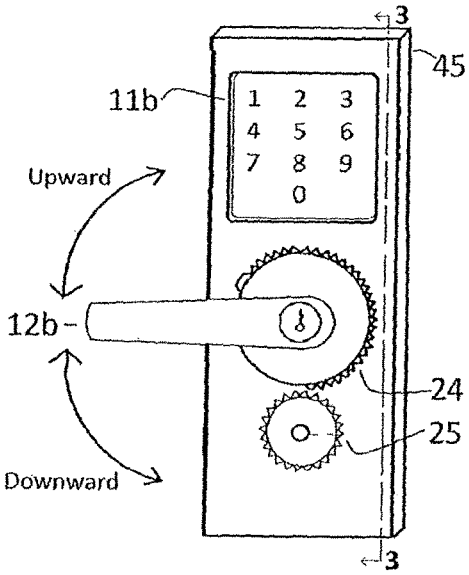
Figure 4:
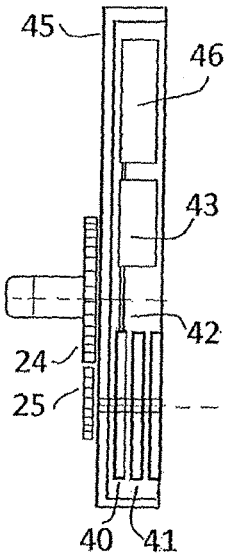
Figure 5:
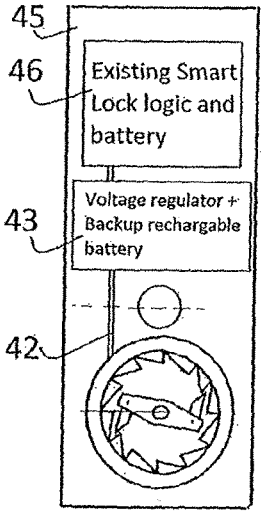

FIGS. 3, 4, 5 correspond to FIGS. 3A, 3B and 3C of the parent application showing the basic smart lock mechanism in related art, as used in the present application, and modified herein as described and shown in FIGS. 1 and 2 with removal of the battery therein.

DETAILED DESCRIPTION

At initial step 1, at the start of a smart lock A in FIG. 1 as shown in FIG. 2, a lock lever of smart lock A is lifted (not shown) to activate a powering dynamo contained within the lock and the lever is returned to its initial position. The lock A is activated to initiate the program at step 2 to inquire whether the controller B is active with an updated key code or not. If controller B is not active then the system moves to step 4 with the key pad lighting up to accept an entered key code as previously programmed. If the controller B is active then at step 3 the lock synchronizes with the controller to receive updated codes and the system moves to step 4 for entry of the code. At step 5 the lock system checks whether the entered code matches any key code in a key code storage table. If there is a match, then the door is unlocked at step 6. If there is an invalid code then the system moves to step 7 to see if the invalid code has been entered more than 3 times and, if so, the lock is disabled for 15 minutes (or other pre-selected time period). If an invalid code has been entered less than 3 times, the system moves in a loop, as shown, for entry of a new code.

Lock A, in FIG. 1 is shown in more detail in FIGS. 3, 4 and 5, as taken from FIGS. 3A, 3B and 3C, of the parent application hereof which is incorporated herein in its entirety by reference thereto as related art, as above. Lock 45 includes an electrically operable keypad 11*b* for entry of requisite key codes. Dynamo 40, with operating gears 24 and 25, and flywheel 41, with circuit 42, serve to mechanically generate sufficient electrical power to operate the keypad 11*b* and also to power the smart lock logic or electronic control element 46 for operation, as depicted in FIG. 2, without the battery of the prior art. Up and down movement of door lock lever 12*b* of the prior art, as described in the parent application, is modified in accordance with the operational logic of FIG. 2 to effect key code updating (with initial up movement of the lever), without battery power normally constantly on, as in the related art but which is not available, except on demand, in the present invention. Battery related element 43 of the related art of the parent application is neither required nor present in the lock A of the present invention.

It is understood that the above description and details are exemplary of the invention and that changes in the process and details may be made without departing from the scope of the invention as defined in the following claims.

What is claimed is:

1. A smart lock system comprising:

i. an electrically operable smart lock element configured to be affixed to a door and having a locking mechanism configured for locking/unlocking the door, the smart lock element comprising:

a. an electrically powered key pad configured for the entry of a currently valid key code for opening of the locking mechanism and the door;

b. an externally manually operatively accessible mechanically operated power generator directly electrically connected to the smart lock element for solely providing operating energy, for powering the smart lock element, without any other power source, and for powering the electrically powered key pad for operative entry of the currently valid key code for unlocking the locking mechanism; and c. an electronic control element;

ii. a remote, separate controller element configured to be in communication with the smart lock element, via a communication connection, only when the mechanically operated power generator provides operating energy to the smart lock element, and wherein the controller element is configured to constantly receive and store updated constantly changing currently valid key code information from a location source remote from the controller element and to transmit the currently valid key code information to the smart lock element when in communication therewith;

the remote location source generating and communicating constantly changing currently valid key code information to the controller element;

iii. a communication router to which the smart lock element is electronically connected for the communication connection, when the smart lock element is provided with the operating energy;

wherein the electronic control element within the smart lock element is configured to synchronize with the controller element, only upon the providing of the operating energy and activation of the electronic control element with an activation element to receive and store the changing and currently valid updated key code information prior to any unlocking activation of the locking mechanism, and with the electronic control element configured to compare received and stored currently valid key code information corresponding to the current valid updated key code information with entered key codes via the electrically powered key pad; and wherein the locking mechanism is configured to be unlocked thereafter by an operator of the electrically powered key pad with direct entry of a currently valid key code, separately known to the operator of the electrically powered key pad, corresponding to the currently valid key code currently stored in the electronic control element.

2. The smart lock system of claim 1, wherein the smart lock element comprises a lever element configured to mechanically operate the power generator with a movement in one direction away from a rest position for generation of the operating energy and simultaneously therewith to effect the synchronization of the electronic control element and the controller element for transmission of any updated currently valid key code information.

3. The smart lock system of claim 1, wherein the communication is via an internet connection and wherein the communication router is a Wi-Fi router.

4. A method of operation of a smart lock system, with remotely generated constantly changing key codes, for closing and opening a door locked with the smart lock system, by an operator of the lock, comprising the steps of:

a) providing a smart lock on a door, with the smart lock having an electrically powered key pad for direct entry by the operator of a currently valid key code separately known by the operator, an electronic control element, and a manually operationally accessible mechanically operated dynamo as a sole power source for the smart lock;

b) providing a controller element separate and remote from the smart lock and configured to be in data transmission communication with the smart lock only upon powering of the smart lock with the dynamo, wherein the controller element is configured to receive constantly changing updated currently valid key code information from a source remote thereto and to transmit the updated currently valid key code information to the smart lock for operational storage in the electronic control element;

c) configuring the mechanically operated dynamo to open communication with the controller upon initial activation of the dynamo to provide power, and prior to entry of the currently valid key code, to effect transmission of updated currently valid key code information; and d) completion of powering the smart lock with the dynamo for direct electrically powered entry of a currently valid key code corresponding to the current updated valid key code information via the electrically powered key pad;

e) electrically powered comparison, by the electronic control element, of the directly entered key code by the operator with the electrically powered key pad, with a stored current key code for the validation thereof and the opening of the door.

* * * * *